US008096930B1

(12) United States Patent
Leon

(10) Patent No.: US 8,096,930 B1
(45) Date of Patent: Jan. 17, 2012

(54) EXERCISE APPARATUS ADAPTED TO FACILITATE STAND-UP CRUNCHES

(75) Inventor: Oscar Leon, San Clemente, CA (US)

(73) Assignee: Muscle Dynamics Corporation, Santa Fe Springs, CA (US)

( * ) Notice: Subject to any disclaimer, the term of this patent is extended or adjusted under 35 U.S.C. 154(b) by 0 days.

(21) Appl. No.: 12/965,605

(22) Filed: Dec. 10, 2010

(51) Int. Cl.
*A63B 21/00* (2006.01)

(52) U.S. Cl. ..... 482/142; 481/140; 481/130

(58) Field of Classification Search ..... 482/142, 482/130, 104–108
See application file for complete search history.

(56) References Cited

U.S. PATENT DOCUMENTS 7,731,639 B1 * 6/2010 Shifferaw ..... 482/92

* cited by examiner

*Primary Examiner* — Jerome w Donnelly
(74) *Attorney, Agent, or Firm* — Jafari Law Group, Inc.; David V. Jafari

(57) ABSTRACT

The invention is an exercise equipment apparatus. More specifically, the invention is for an exercise equipment apparatus that facilitates performance of variations of a boxer crunch stand. An exercise equipment apparatus in accordance with the present invention comprises a frame, a substantially rectangular pad coupled to the frame, a first pair of substantially cylindrical pads coupled to the frame, and a second pair of substantially cylindrical pads coupled to the frame, and situated between the rectangular pad and the first pair of cylindrical pads, wherein the cylindrical pads height level may be adjustable for users of various heights.

14 Claims, 7 Drawing Sheets

EXERCISE APPARATUS ADAPTED TO FACILITATE STAND-UP CRUNCHES

TECHNICAL FIELD OF THE INVENTION

The present invention relates in general to an exercise equipment apparatus for facilitating stand-up crunches.

COPYRIGHT & TRADEMARK NOTICE

A portion of the disclosure of this patent application may contain material that is subject to copyright protection. The owner has no objection to the facsimile reproduction by any one of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and shall not be construed as descriptive or to limit the scope of this invention to material associated only with such marks.

BACKGROUND OF THE INVENTION

With the limited number of fitness exercises in a workout session, there is a crucial need for athletes or exercisers with various fitness goals to perform exercise routines that efficiently strengthen various muscles and simultaneously provide ideal physical conditioning. Proven to provide the ideal balance of strength and conditioning fitness, boxing workouts have become extremely popular not only amongst boxers but also amongst individuals with various fitness goals. The boxers stand crunch may be performed in variations, but a common feature of the exercise is to lift the body of the individual to a seated position and ultimately to a standing position relying on firm positioning of legs and feet. Once in a standing position, the individual has the option to perform additional upper body exercises, such as a boxing punch combination, before returning to the seated position for the next repetition of the boxers stand crunch.

Boxers stand crunch is a unique exercise that not only strengthens various muscles efficiently in one routine but also provides exceptional physical conditioning. The individual is also able to maintain a high heart rate during the exercise enabling consumption of higher calories than other exercises targeting solely the muscle strength. However, boxers stand crunch may require assistance of a trainer or another individual. Trainers are expensive and another individual may not be available to supervise during workout. Current workout benches do not provide the proper positioning and the firm grip necessary to perform variations of boxers stand crunch. Without an apparatus designed specifically to secure lower body position and support the back of an individual, variations of boxers stand crunch exercise may be hard to perform, and may even result in injuries to various body parts.

Thus, there is a need for an apparatus that secures the feet of the exerciser firmly and safely to obviate the need for the assistance of another individual. Further, there is a need for an apparatus that provides support for the back of the exerciser to decrease risk of injuries from lifting pressure on the back and neck of the exerciser. The apparatus further needs to ensure that the individual's lifting force is focused on the targeted muscles including but not limited to the abdominal and upper body muscles by securing necessary body parts that the exerciser leverages to reach a seated position and ultimately to a standing position. It would be ideal for the apparatus to be adjustable for use of individuals with various heights. Specifically, there is a need for a back support apparatus that also secures the individual's lower body and feet to perform boxers stand crunch safely and efficiently without assistance of another individual. It is to these ends that the present invention has been developed.

SUMMARY OF THE INVENTION

To minimize the limitations in the prior art, and to minimize other limitations that will be apparent upon reading and understanding the present specification, the present invention describes an exercise apparatus designed to enable the exerciser to perform variations of boxers stand crunch safely and without assistance of another individual.

The exercise equipment apparatus comprises a frame, a substantially rectangular pad coupled to the frame, a first pair of substantially cylindrical pads coupled to the frame, and a second pair of substantially cylindrical pads coupled to the frame and situated between the rectangular pad and the first pair of pads.

It is an objective of the present invention to provide support for lower body and the back of an individual to perform such exercise routines as a boxers stand crunch, a standard crunch to lift to a seated position, a boxers stand crunch followed by further exercises after reaching the standing position, or any type of crunch using medicine ball or other workout devices, or any other combination or variations of crunches.

It is another objective of the present invention to secure lower body of the user specifically feet and legs of the user, and to provide a support apparatus for the individual's back in a lying position to reduce undesirable pressure on neck, back, and other body parts and also to provide a safe support for mid and upper body to facilitate the lifting exercise. The apparatus is adjustable to allow for different body heights to perform boxers stand crunch safely and efficiently.

It is yet another objective of the present invention to eliminate the need for assistance of another individual to firmly position the lower and mid body of the user.

Finally, it is yet another objective of the present invention to allow for focusing individual's efforts into the targeted muscles such as abdominals by securing lower body and providing support for the back of the individual. The present invention further allows for an ideal balance of conditioning and muscular strength exercise while helping the user to maintain an ideal heart rate for more efficient workout results all in one exercise routine.

These and other advantages and features of the present invention are described herein with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 4(*b*) is a side view of the exercise equipment apparatus depicting the person transitioning into a crunch position and lifting off his body from the rectangular pad.

FIG. 4(*c*) is a side view of the exercise equipment apparatus depicting the person transitioning into a standing position where boxing punches are then conducted.

DETAILED DESCRIPTION OF THE DRAWINGS

In the following discussion that addresses a number of embodiments and applications of the present invention, reference is made to the accompanying drawings that form a part hereof, where depictions are made, by way of illustration, of specific embodiments in which the invention may be practiced. It is to be understood that other embodiments may be utilized and changes may be made without departing from the scope of the present invention.

Figure 1:
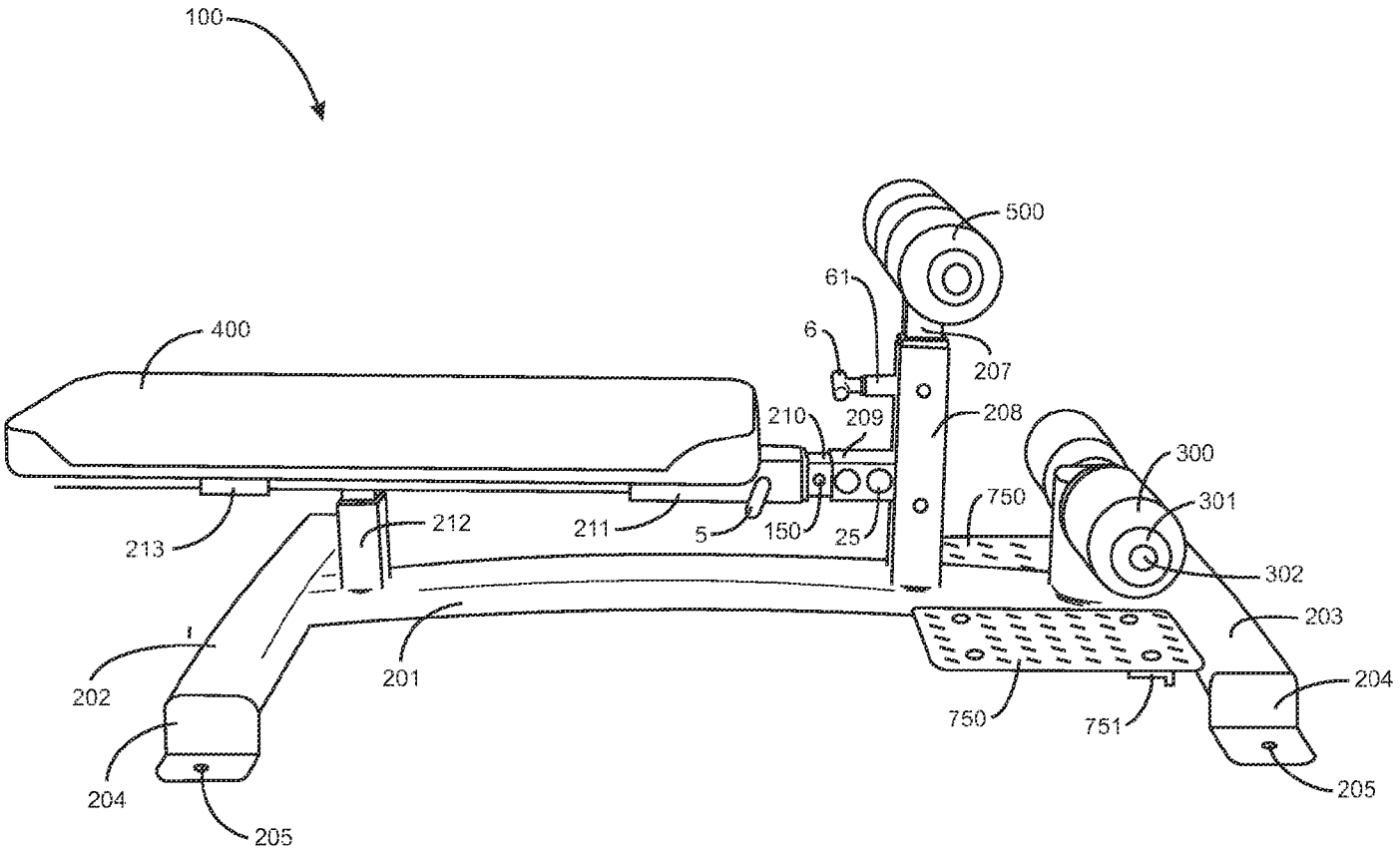
FIG. 1 is a perspective view of an exemplary embodiment of the present invention depicting the exercise equipment apparatus with a frame, a substantially rectangular pad coupled to the frame, a first pair of substantially cylindrical pads coupled to the frame, and a second pair of substantially cylindrical pads coupled to the frame, and situated between the rectangular pad and the first pair of cylindrical pads.

FIG. 1 is a perspective view of an exemplary embodiment of the present invention depicting the exercise apparatus 100 with a frame 200, a substantially rectangular pad 400 coupled to the frame 200, a first pair of substantially cylindrical pads 300 coupled to the frame 200, and a second pair of substantially cylindrical pads 500 coupled to the frame 200, and situated between the rectangular pad 400 and the first pair of cylindrical pads 300.

Exercise apparatus 100 is used for facilitating a stand-up crunch exercise routine, commonly known as a "boxer stand crunch." This particular exercise routine will be explained in further detail in FIGS. 4(*a*)-(*c*). Frame 200 of the exercise apparatus 100 includes a central support member 201 as well as a plurality of mounts 202 and 203. The central support member 201 of the frame 200 structurally supports and is attached to the various exercise apparatus components, which will be explained in further detail herein. Mounts 202 and 203 are coupled to central support member 201 in a substantially perpendicular position. Further, mounts 202 and 203 may include a plurality of leg brackets 204 on opposite ends of each that allow for the entire frame 200 structure to be lifted off of a floor or ground surface. In addition, leg brackets 204 contain mount openings 205 that allows for the exercise apparatus 100 to be securely attached to a floor surface in order to maintain, for example, the overall stability of the exercise apparatus 100. Additionally, a user may desire to attach exercise apparatus 100 to a floor surface via mount openings 205 for security reasons or to maintain the overall layout in a gym setting.

At one end of exercise apparatus 100 is located the first pair of substantially cylindrical pads (first pair of pads) 300 coupled to the frame 200. The first pair of cylindrical pads 300 is located on a first fixed vertical member 206 that is coupled perpendicularly to the central support member 201 of frame 200. The first pair of cylindrical pads 300 is attached to opposite sides of the first fixed vertical member 206. First pair of cylindrical pads 300 may be attached to first fixed vertical member 206 by two rods 10 (not shown in FIG. 1) that are located longitudinally inside the center axis of each pad of the first pair of cylindrical pads 300. The two rods 10 provide structural support for the first pair of cylindrical pads 300 as well as for the weight or pressure exerted by a person conducting an exercise routine on the exercise apparatus 100.

Located below each pad of the first pair of cylindrical pads 300 is a flat base member 750. Each flat base member 750 is attached to opposite sides of the central support member 201 of frame 200 via a plurality of metal brackets 751 that extend out from central support member 201 and below each flat base member 750. Each flat base member 750 is long and wide enough to accommodate the foot size of a variety of persons who may use the exercise apparatus 100. The flat base members 750 may be made of a metal material with a treaded surface pattern for purposes of enhanced friction between a user's footwear and each flat base member 750 while the user conducts an exercise routine. However, the flat base members 750 may be made of other comparable materials, and the embodiment described should not be construed as limiting the scope of the present invention.

First pair of cylindrical pads 300 may be made of a dense, sturdy but malleable foam (not shown) in a generally cylindrical shape form. This allows for sturdy support of a user's upper foot region when placed under the first pair of cylindrical pads 300, but is also soft and malleable enough so as not to cause the user undue pressure, stress or even damage to the user's upper foot region while conducting an exercise routine. In addition, the foam portion comprising the body of the first pair of cylindrical pads 300 are covered by a thick, sturdy fabric material that is resilient to continued, repetitive use as well as impermeable to solid or liquid substances, such as when a user sweats or perspires during an exercise routine.

The sturdy fabric material covering the entire inner body of the first pair of cylindrical pads 300 is generally tucked around each pad and securely closed at each of their outer ends. The securing of the sturdy fabric material may be effected by connecting a washer device 301 and bolt device 302 to the rod located within each of the pads of the first pair of cylindrical pads 300 to secure the fabric lining in place. However, this should not be interpreted as limiting the scope of the present invention, and comparable and suitable alternative materials may be used to effect the same components and purposes as herein described.

At the opposite end from first pair of cylindrical pads 300 on the exercise apparatus 100 is substantially rectangular pad 400, which is situated horizontally to the central support member 201 of the frame 200. In between the first pair of cylindrical pads 300 and substantially rectangular pad 400 is a second pair of cylindrical pads 500 that are also coupled to the frame 200. The second pair of cylindrical pads 500 is located on opposite sides of an adjustable vertical member 207. The adjustable vertical member 207 is situated within a second fixed vertical member 208, both of which are attached in a substantially perpendicular position to frame 200. The adjustable vertical member 207 is adapted to slide longitudinally within the second fixed vertical member 208. Additionally, the second pair of cylindrical pads 500 is located on the frame 200 at a higher vertical position than the first pair of cylindrical pads 300. As will be explained later with respect to FIG. 3, the second pair of cylindrical pads 500 is not only at a higher vertical position than the first pair of cylindrical pads 300, but may be vertically adjustable for purposes of different users' body sizes and proportions.

Similar to the first pair of cylindrical pads 300, the second pair of cylindrical pads 500 may be made of the same type of materials. The second pair of cylindrical pads 500 may be made of a dense, sturdy but malleable foam (not shown) shaped in a cylindrical form. The foam portion comprising the body of the second pair of cylindrical pads 500 is covered by a thick, sturdy fabric material. The second pair of cylindrical pads 500 supports the inner leg portion of a user when conducting an exercise routine. The cylindrical shape of the second pair of cylindrical pads 500 allows for a user's inner leg portion, such as the back of the knee area, to be comfortably supported throughout the exercise routine. Furthermore, the cylindrical shape of the second pair of cylindrical pads 500 is particularly desirable since its shape can generally mold to the user's inner leg portion. This not only allows for the user's inner leg region to be comfortably supported, but reduces unnecessary stress and impact on the user's body, especially while doing an exercise routine that involves a great deal of repetition. However, the cylindrical shape of the second pair of cylindrical pads 500 should not be construed as limiting alternative shapes and molds that could effectuate the same or similar purposes as herein described.

The substantially rectangular pad 400, which is situated horizontally to the central support member 201 of the frame 200, allows for a user to place his or her body portion on the exercise apparatus 100. Substantially rectangular pad 400 is situated horizontally to the central support member 201 of the frame 200. Specifically, substantially rectangular pad 400 is supported by a first fixed horizontal member 209 that is situated perpendicularly to the second fixed vertical member 208. Substantially rectangular pad 400 is also supported by a second fixed horizontal member 210, which is situated longitudinally within the first fixed horizontal member 209.

The first fixed horizontal member 209 is just long enough to generally structurally support the second fixed horizontal member 210 and substantially rectangular pad 400. Additionally, the second fixed horizontal member 210 may be permanently attached within the first fixed horizontal member 209 by a plurality of bolts 25 that fit within a plurality of openings (not shown in this view) located where the first and second fixed horizontal members, 209 and 210, intersect longitudinally. Bolts 25 allow for the second fixed horizontal member 210 to be securely held in place within the first fixed horizontal member 209. Substantially rectangular pad 400 is attached to an adjustable horizontal member 211, which is located toward the end of substantially rectangular pad 400 located near the first fixed horizontal member 209. Second fixed horizontal member 210 is located longitudinally within the adjustable horizontal member 211 for purposes of adjustability of the substantially rectangular pad 400 (to be explained in further detail in FIG. 2).

Also supporting substantially rectangular pad 400 is a third fixed vertical member 212 that is attached to the second fixed horizontal member 210 at or near to its center position and toward the end of central support member 201 on the end farthest from the first pair of cylindrical pads 300. The third fixed vertical member 212 may be positioned substantially perpendicular to central support member 201 of frame 200. Third fixed vertical member 212 provides additional structural integrity to substantially rectangular pad 400 when in use by a person conducting an exercise routine.

On the opposite side of the third fixed vertical member 212 from the adjustable horizontal member 211 is a guide 213 that is attached to substantially rectangular pad 400. The second fixed horizontal 210 is also situated longitudinally within guide 213 so that guide 213 can slide longitudinally along second fixed horizontal 210 for adjustment purposes (to be explained in further detail in FIG. 2 discussion).

A user may place his or her back region on the substantially rectangular pad 400 in order to place him or herself into a start position of an exercise routine. However, this length should not be construed as limiting the proportion of the substantially rectangular pad 400 and the substantially rectangular pad 400 may be long and wide enough in length and width to support the back region of a variety of heights and proportions of people. In addition, the substantially rectangular pad 400 should be thick enough to provide adequate support to a user's back region so that the surface is generally soft, yet firm for supporting continued repetitive use of the exercise apparatus 100. As will be explained with respect to FIG. 2, the substantially rectangular pad 400 is horizontally adjustable for purposes of different users' body sizes and proportions.

Substantially rectangular pad 400 may also made of a firm, but soft foam (not shown) that is covered by a durable thick, sturdy fabric material similar to or the same as the materials used for making the first and second pair of cylindrical pads, 300 and 500. Again, this allows for the substantially rectangular pad 400 to be resilient to continued repetitive use as well as generally impermeable to substances such as a user's sweat and perspiration.

Figure 2:
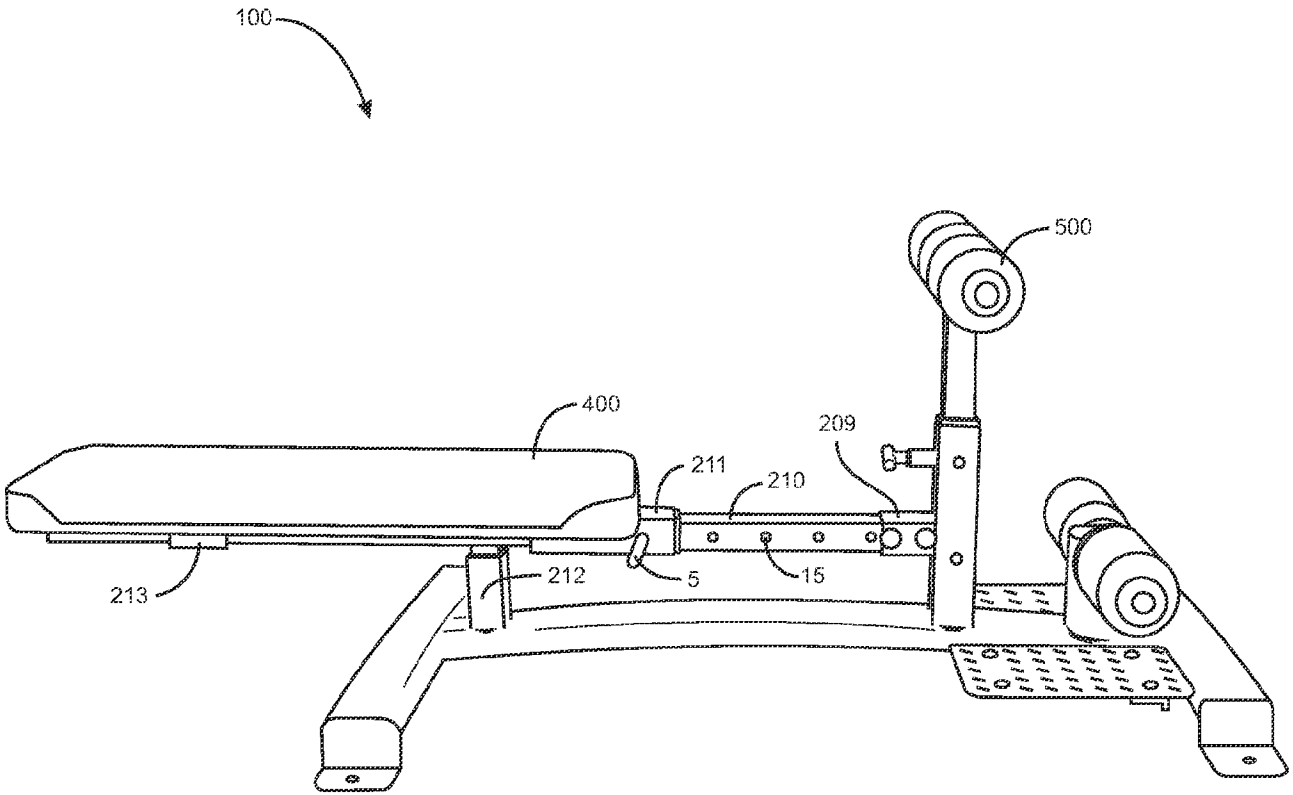
FIG. 2 is a perspective view of an exemplary embodiment of the present invention depicting the rectangular pad in a horizontally adjusted position.

FIG. 2 is a perspective view of an exemplary embodiment of the exercise apparatus 100 depicting the substantially rectangular pad 400 in a horizontally adjusted position. As indicated in FIG. 1, substantially rectangular pad 400 may be adjusted horizontally for purposes of different users' body sizes and proportions. For example, if a user is tall, particularly in the upper-leg region, he or she may desire to adjust the substantially rectangular pad 400 away from the second pair of cylindrical pads 500 for better ease in use of the exercise apparatus 100. For reference, in FIG. 1, adjustable horizontal member 211 was positioned near to first fixed horizontal member 209. In FIG. 2, adjustable horizontal member 211 is located at a farther distance from first fixed horizontal member 209 and nearer to third fixed vertical member 212. On second fixed horizontal member 210, there is a plurality of equidistant openings 15 located longitudinally along its sides. In an exemplary embodiment, there may be as at least three openings 15 on second fixed horizontal member 210 to accommodate a range of heights and sizes of users of the exercise apparatus 10.

The adjustable horizontal member 211 also comprises an adjustable pin 5 that may be positioned horizontally and perpendicularly within adjustable horizontal member 211. Adjustable pin 5 is located within a fixed cylindrical channel area 51 (not shown in this view) that is also horizontally and perpendicularly located on adjustable horizontal member 211. If a user desires to adjust the position of substantially rectangular pad 400, the user may pull adjustable pin 5 substantially out from within adjustable horizontal member 211, and then slide adjustable horizontal member 211 to or away in distance from the first fixed horizontal member 209. As the user slides the adjustable horizontal member 211 longitudinally along the second fixed horizontal member 210, guide 213 will also slide longitudinally along second fixed horizontal member 210. In all, both adjustable horizontal member 211 and guide 213 carry substantially rectangular pad 400 longitudinally along second fixed horizontal member 210 in a horizontal direction movement. In order to secure the particular position desired, the user would line up the adjustable pin 5 with one of the openings 15 on the second fixed horizontal member 210, and then slide the adjustable pin 5 back within the fixed cylindrical channel 51 as well as the opening 15 of second fixed horizontal member 210.

When a user slides the adjustable pin 5 out of adjustable horizontal member 211, the adjustable pin 5 is not entirely removable from the fixed cylindrical channel 51. Adjustable pin 5 may function with a spring mechanism (not shown)

located within the fixed cylindrical channel 51 so that the adjustable pin 5 can easily be moved in and out of it for adjustment purposes. However, this should not be construed as limiting the type of adjustable pin used to effectuate the same purpose in the present invention.

Figure 3:
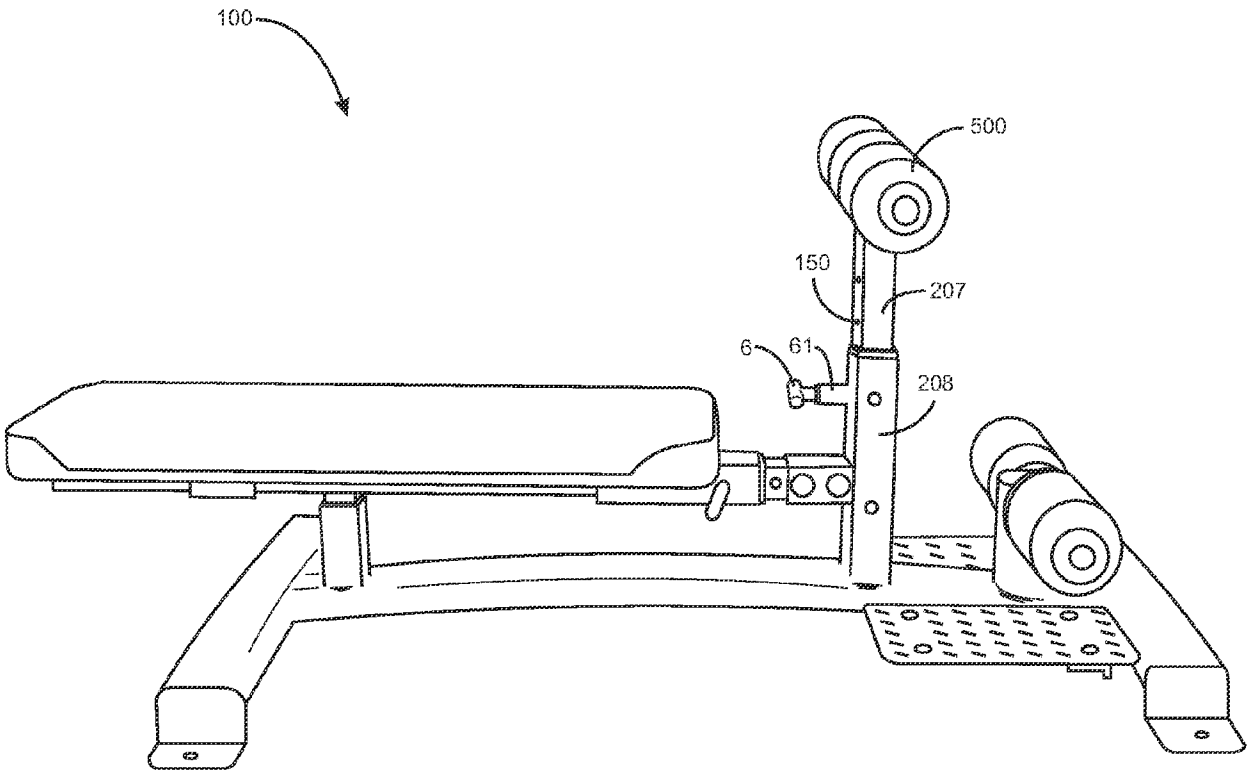
FIG. 3 is a perspective view of an exemplary embodiment of the present invention depicting the second pair of cylindrical pads in a vertically adjusted position.

FIG. 3 is a perspective view of an exemplary embodiment of the present invention depicting the second pair of cylindrical pads 500 in a vertically adjusted position. As indicated in FIG. 1, the second pair of cylindrical pads 500 may be adjusted vertically for purposes of different users' body sizes and proportions. For example, if a user is tall, particularly in the height of his or her legs, he or she may desire to adjust the second pair of cylindrical pads 500 up in a higher vertical position for better ease in use of the exercise apparatus 100. For reference, in FIG. 1, the second pair of cylindrical pads 500 on the adjustable vertical member 207 was positioned near to the second fixed vertical member 208. In FIG. 2, the second pair of cylindrical pads 500 is located at a higher distance upward from the second fixed vertical member 208. On the second fixed vertical member 208, there is a plurality of equidistant openings 150 located longitudinally along its sides. In an exemplary embodiment, there may be as many at least three equidistant openings 150 on the second fixed vertical member 208 to accommodate a range of heights and sizes of users of the exercise apparatus 100.

As similarly explained with respect to FIG. 2, the second fixed vertical member 208 also comprises an adjustable pin 6 that may be positioned horizontally and perpendicularly to it. Adjustable pin 6 is located within a fixed cylindrical channel area 61 that is also horizontally and perpendicularly located on the second fixed vertical member 208. If a user desires to adjust the position of the second pair of cylindrical pads 500, the user may pull adjustable pin 6 substantially out from within the fixed cylindrical channel 61, and then the adjustable vertical member 207 and the second pair of cylindrical pads 500 up or down in distance from the second fixed vertical member 208. In order to secure the particular position desired, the user would line up the adjustable pin 6 with one of the openings 150 on the second fixed vertical member 208, and then slide the adjustable pin 6 back within the fixed cylindrical channel 61 as well as the opening 150 of second fixed vertical member 208.

When a user slides the adjustable pin 6 out of the second fixed vertical member 208, the adjustable pin 6 is not entirely removable from the fixed cylindrical channel 61. Adjustable pin 6 may function with a spring mechanism (not shown) located within the fixed cylindrical channel 61 so that the adjustable pin 6 can easily be moved in and out of it for adjustment purposes. However, this should not be construed as limiting the type of adjustable pin used to effectuate the same purpose in the present invention.

Figure 4A:
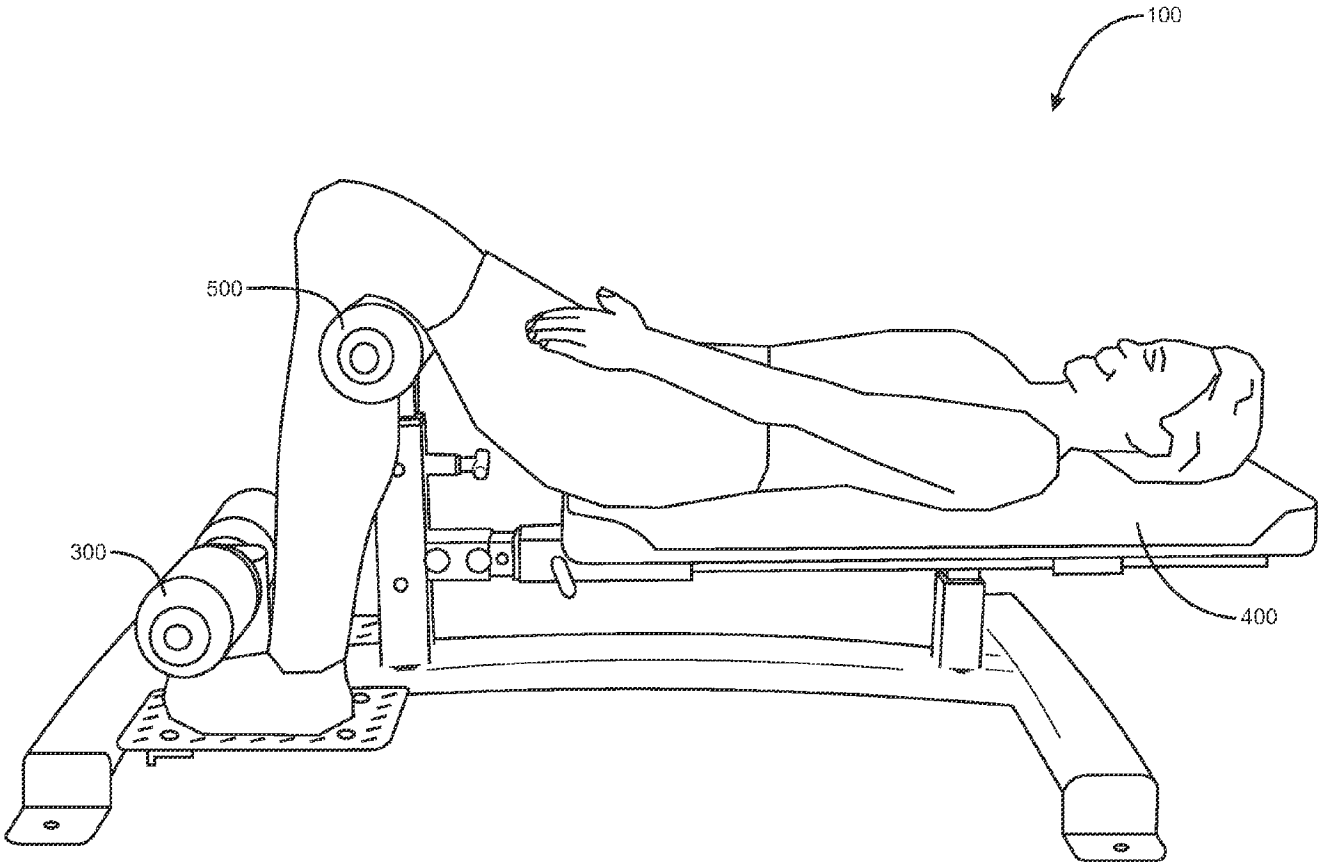
FIG. 4(*a*) is a side view of the exercise equipment apparatus depicting a person lying on the apparatus in a start position of the stand-up crunch exercise routine.
Figure 4B:
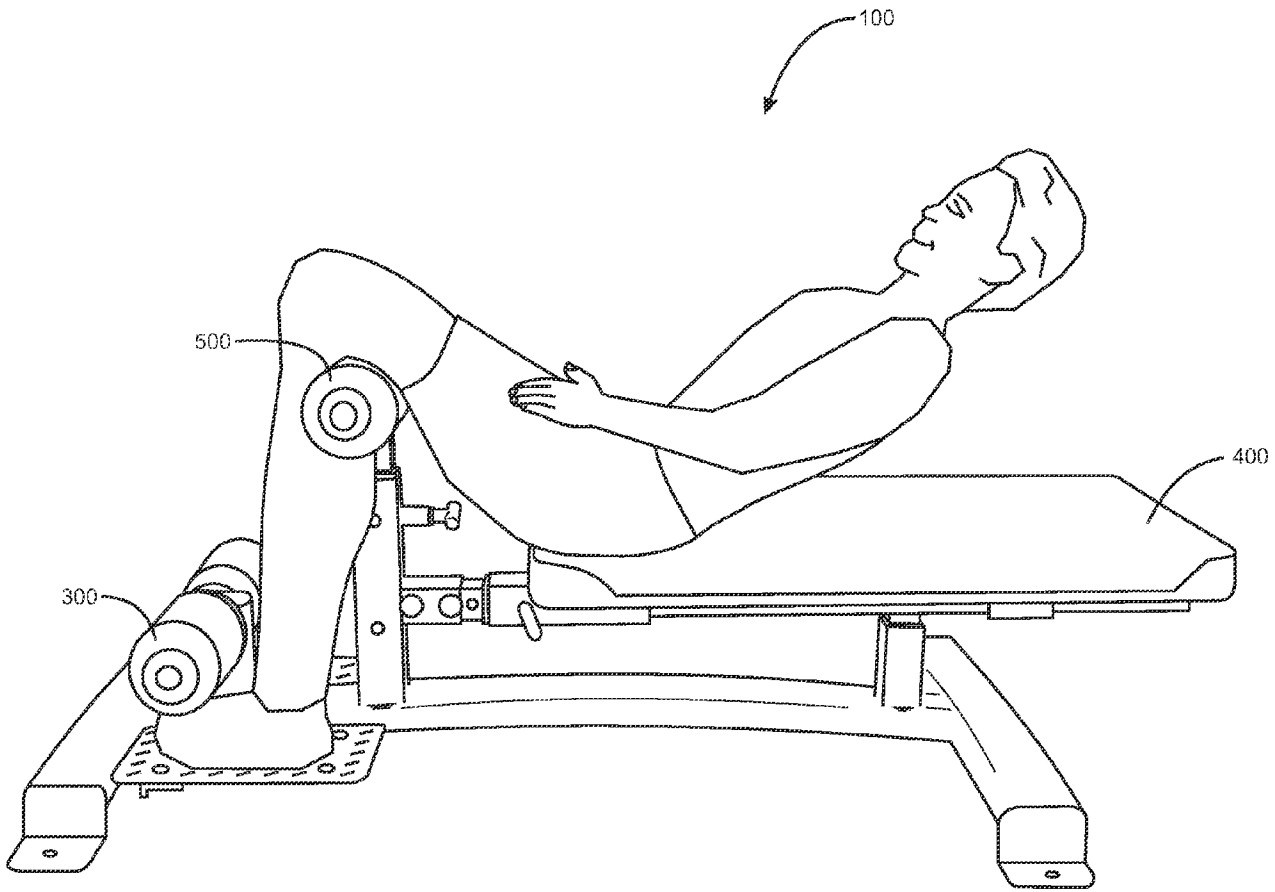
Figure 4C:
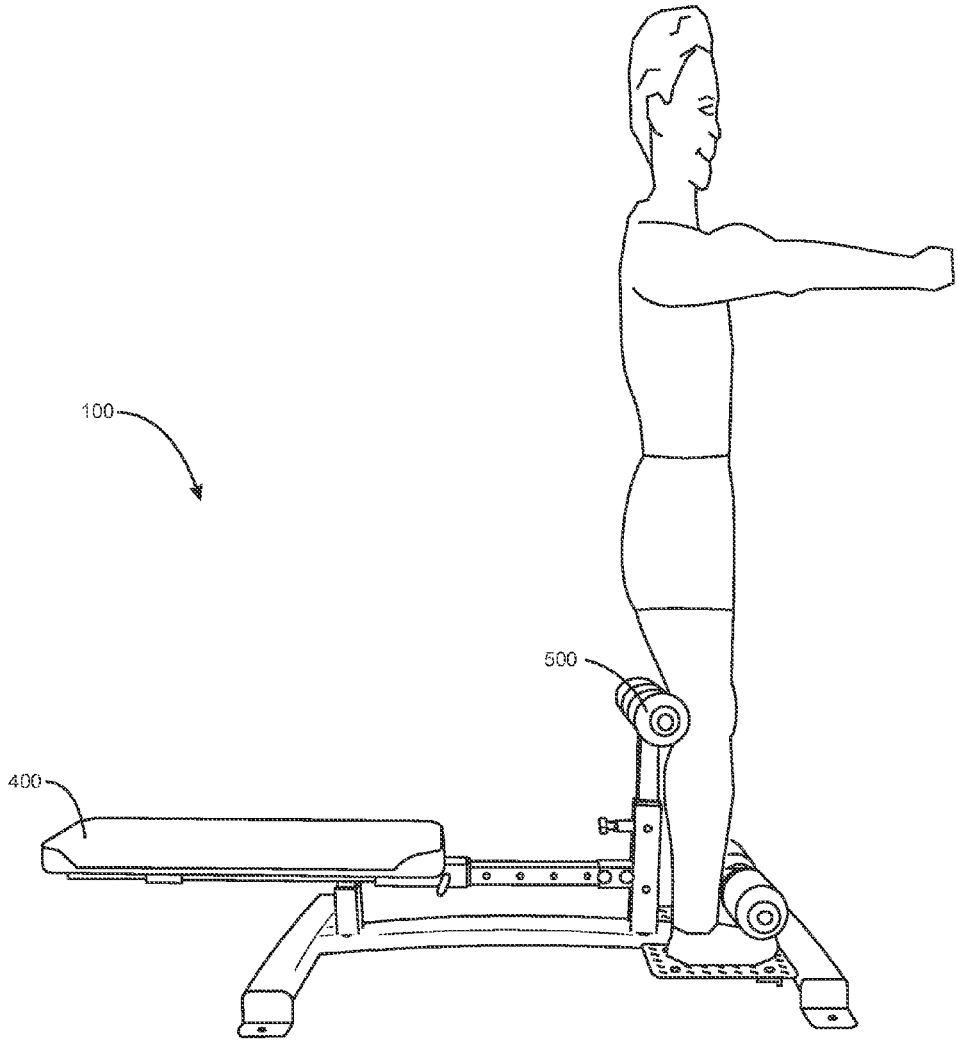

FIG. 4(*a*) is a side view of the exercise equipment apparatus depicting a person lying on the exercise apparatus 100 in a start position of a stand-up crunch exercise routine. In an exemplary use of the present invention, a user will perform an exercise routine that is known in the sports industry as a "boxer stand crunch." In order to commence this exercise routine, a user of the exercise apparatus 100 may start by sitting down at the edge of substantially rectangular pad 400 nearest to the second pair of cylindrical pads 500 in order to acquaint himself with where to position himself.

Then the user may position his legs over the second pair of cylindrical pads 500 so that the back of his knees are generally lying atop of the second pair of cylindrical pads 500. Next, the user may then place his feet underneath the first pair of cylindrical pads 300. Upon attempting to position his feet underneath the first pair of cylindrical pads 300, the user may find that the second pair of cylindrical pads 50 needs to be adjusted to accommodate the user's height and body proportions. Depending on the user's overall leg length, he may have to adjust the second pair of cylindrical pads 500 via the adjustable vertical member 207 and adjustable pin 6 either upwards or downwards. Once the user has adjusted the second pair of cylindrical pads 500 to his comfort, the user may transition from sitting on the substantially rectangular pad 400 to lying his back down upon the length of the substantially rectangular pad 400 in order to prepare for performing the exercise routine. After lying down on substantially rectangular pad 400, the user may place his arms to the side of his body to generally rest upon the substantially rectangular pad 400 or cross them across his chest depending on his preference.

FIG. 4(*b*) is a side view of the exercise equipment apparatus 10 depicting the user transitioning into a crunch position and lifting off his body from the substantially rectangular pad 400. Once lying down upon the substantially rectangular pad 400, the user then has to transition into a crunch position. The user will lift his upper body portion toward his upper thighs in order to perform the crunch-up portion of the exercise. As the user is performing the crunch-up portion, he will also begin to lift his buttocks off of the substantially rectangular pad 400. By lifting his buttocks, and consequently his entire body, off of the substantially rectangular pad 400, this enables the user to transition into a standing position. The first and second pair of cylindrical pads, 300 and 500, also provides the balance, stability and support needed for the user as he transitions up into a standing position. Since the first and second pair of cylindrical pads, 300 and 500, provides stability in conducting the stand-up crunch exercise routine, a user does not need to have another person support his feet or legs during the routine.

FIG. 4(*c*) is a side view of the exercise apparatus 100 depicting the user in a standing position where boxing punches are then conducted. Once the user has transitioned into a standing position, the user will then conduct a boxing punch combination. For example, the user may throw a two punch combination by alternating each throw punch with first the right arm and then the left arm. Alternatively, the user may desire to perform a combination of punches commonly practiced among boxers, or in other related sports.

Once the user performs the particular boxing punch combination or sequence desired, the user will then transition to the start position (referenced above). First the user will lean back toward the second pair of cylindrical pads 500 so that the inner leg portion is touching it as the user then bends his knees to sit back down on the substantially rectangular pad 400. Once the user is sitting down on the substantially rectangular pad 400, the user will return back to the start position by laying his back down upon the substantially rectangular pad 400. Depending on how many repetitions the user desires to carry out, the above described steps may be continued in the same manner.

The boxer stand crunch exercise routine should not be construed as the only exercise routine that can be performed on the exercise apparatus 100 as other exercise routine variations may be performed depending on the user's preference. Furthermore, the boxer stand crunch exercise routine, as described in FIGS. 4(*a*)-(*c*), should not be construed as the only way to perform this routine. For example, when the user is transitioning into a crunch position, he may choose to stop mid-motion in order to concentrate this particular movement, and then continue up into a crunch position. Accordingly, there may be alternate routines and other exercise repetitions that can be implemented into use of the exercise apparatus 100 without deviating from the scope of the present invention.

Figure 5:
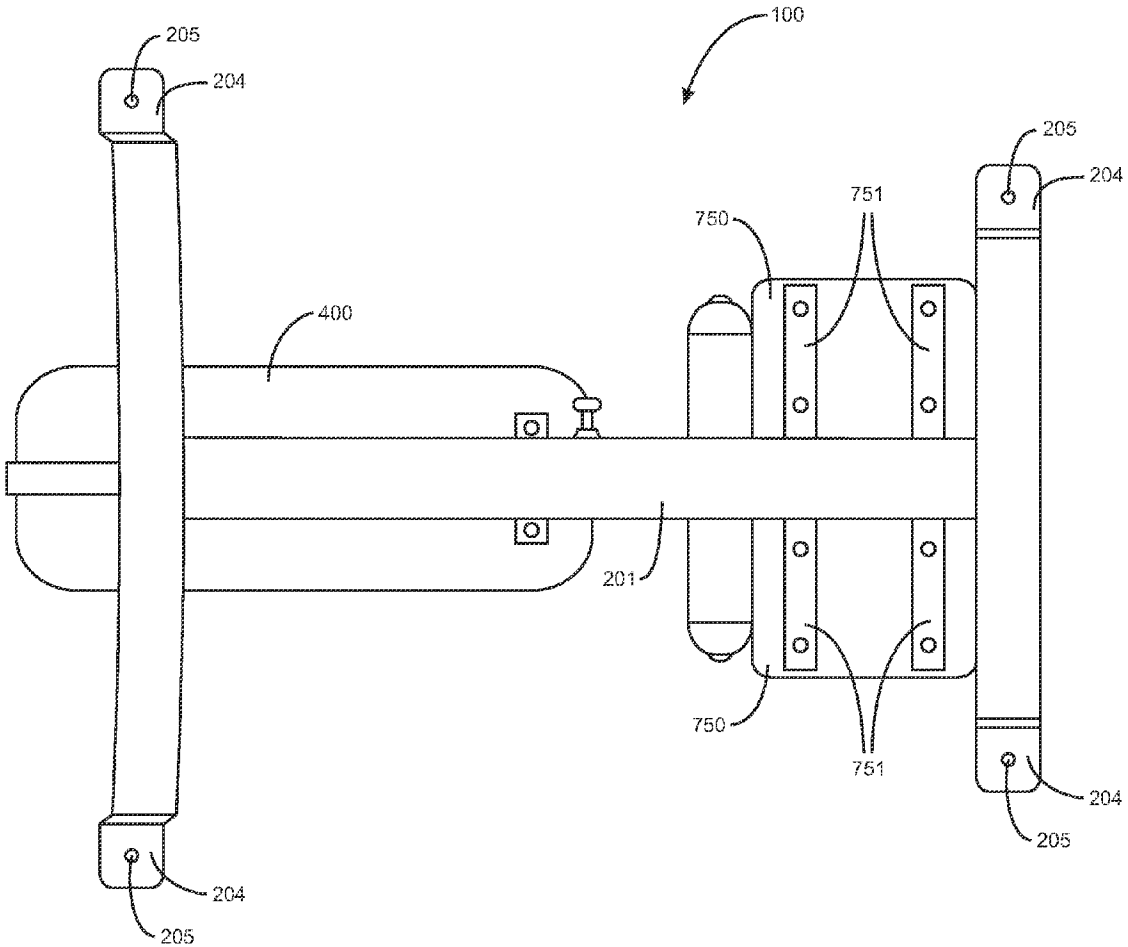
FIG. 5 is a bottom perspective view of the exercise equipment apparatus.

FIG. 5 is a bottom perspective view of the exercise equipment apparatus 100. In this view, each of plurality of metal brackets 751 can be seen that support each flat base member 750. In an exemplary embodiment, there are two metal brackets 751 that support each flat base member 750. Also in this view, each pair of metal bracket 751 extends out from opposite sides of the central support member 201.

Also visible in this view are the under-sides of leg brackets 204 and the mount openings 205. The mount openings 205 provide the option of permanently mounting each leg bracket 204 of exercise apparatus 100 to a ground or floor surface. The exercise apparatus 100 may be permanently mounted to a floor surface by the use of screws or bolts suitable for securing the exercise apparatus 100 to the surface. Also visible in this bottom perspective view of the exercise apparatus 100 are the fixture mechanisms 80 that connect adjustable horizontal member 211 to substantially rectangular pad 400. Adjustable horizontal member 211 may be connected to the bottom of substantially rectangular pad 400 by a bolt or other fixture mechanism commonly known in the art.

An exercise equipment apparatus has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching. It is intended that the scope of the invention not be limited by this detailed description, but by the claims and the equivalents to the claims.

What is claimed is:

1. An exercise equipment apparatus, comprising:

a frame;

wherein the frame further comprises a first fixed vertical member and a second fixed vertical member;

further wherein an adjustable moving vertical member is situated longitudinally within the second fixed vertical member;

a substantially rectangular pad coupled to the frame;

wherein the substantially rectangular pad is situated substantially horizontally with respect to a flat surface on which the frame is placed;

a first pair of substantially cylindrical pads coupled to the frame;

wherein the first pair of cylindrical pads are coupled to opposite sides of the first fixed vertical member; and a second pair of substantially cylindrical pads coupled to the frame, and situated between the rectangular pad and the first pair of cylindrical pads;

wherein the second pair of cylindrical pads is situated on the frame at a higher vertical position than the first pair of cylindrical pad and is adjustable;

further wherein the second pair of cylindrical pads is coupled to opposite sides of the adjustable moving vertical member.

2. The apparatus of claim 1, wherein the adjustable moving vertical member is adapted to slide longitudinally within the second fixed vertical member to adjust a desirable height of the second pair of cylindrical pads.

3. The apparatus of claim 2, wherein the adjustable moving vertical member has spaced apart holes adapted to receive an adjustable pin.

4. The apparatus of claim 3, wherein the second fixed vertical member further comprises a first fixed horizontal member; and wherein a second fixed horizontal member is coupled longitudinally to the first fixed horizontal member, and an adjustable moving horizontal member is coupled longitudinally over the second fixed horizontal member, and the substantially rectangular pad is coupled to the adjustable moving horizontal member, and the adjustable moving horizontal member is adjustable to slide over the second fixed to reach a desirable horizontal position.

5. The apparatus of claim 4, wherein the adjustable moving horizontal member comprises an adjustable pin, and the second fixed horizontal member has at least one hole adapted to receive the adjustable pin of the adjustable moving horizontal member in order to fix the substantially rectangular pad to a desirable horizontal position.

6. The apparatus of claim 5, wherein the frame comprises a third fixed vertical member, wherein the third fixed vertical member of the frame is coupled to the second fixed horizontal member and thereby provides further support for the substantially rectangular pad.

7. The apparatus of claim 6, wherein a guide attached beneath the substantially rectangular pad slides over the second fixed horizontal member to ensure that the substantially rectangular pad's horizontal position is adjustable with additional underlying support.

8. The apparatus of claim 7, wherein the frame further comprises a plurality of floor mounts to maintain the apparatus on a surface.

9. The apparatus of claim 8, wherein the floor mounts comprise a plurality of mount openings to allow for secure attachment to the surface upon which the frame is placed.

10. The apparatus of claim 9, wherein the frame further comprises a plurality of substantially flat base members situated on opposite sides of the first fixed vertical member and below the first pair of cylindrical pads.

11. The apparatus of claim 10, wherein the plurality of flat base members are supported by a plurality of horizontal brackets situated on opposite sides below the first fixed vertical member and the second fixed vertical member.

12. An exercise equipment apparatus, comprising:

a frame;

a substantially rectangular pad coupled in a horizontal position to the frame; and wherein the substantially rectangular pad is horizontally adjustable;

a first pair of substantially cylindrical pads coupled to the frame; and a second pair of substantially cylindrical pads coupled to the frame;

wherein the second pair of cylindrical pads:

(a) is situated between the rectangular pad and the first pair of cylindrical pads;

(b) is situated on the frame at a higher vertical position that the first pair of cylindrical pads; and (c) is vertically adjustable.

13. The apparatus of claim 12, wherein the frame further comprises:

a plurality of floor mounts to maintain the apparatus on a surface;

wherein the floor mounts comprise a plurality of mount openings to allow for secure attachment to the surface upon which the frame is placed;

a first fixed vertical member;

a second fixed vertical member;

a first adjustable moving vertical member;

a second adjustable moving vertical member;

wherein the first adjustable moving vertical member is situated longitudinally within the first fixed vertical member; and wherein the second adjustable moving vertical member is situated longitudinally within the second fixed vertical member; and wherein the second fixed vertical member of the frame further comprises a first fixed horizontal member;

wherein the first fixed horizontal member is coupled longitudinally to a second fixed horizontal member; and wherein an adjustable moving horizontal member is situated longitudinally over the second fixed horizontal member, and the adjustable moving horizontal member slides over the second fixed horizontal member to reach an adjusted horizontal level;

wherein the first pair of substantially cylindrical pads coupled to the first adjustable moving vertical member of the frame; and wherein second pair of substantially cylindrical pads coupled to opposite sides of the second adjustable moving vertical member.

14. An exercise equipment apparatus, comprising:

a frame;

wherein the frame comprises a plurality of floor mounts to maintain the apparatus on a surface; and wherein the floor mounts comprise a plurality of mount openings to allow for secure attachment to the surface upon which the frame is placed; and the frame further comprises:

a first fixed vertical member;

a second fixed vertical member;

an adjustable moving vertical member;

wherein the adjustable moving vertical member is situated longitudinally within the second fixed vertical member; and wherein the second fixed vertical member of the frame further comprises a first fixed horizontal member;

a substantially rectangular pad is coupled to the frame and situated horizontally to the surface on which the frame is placed;

wherein the rectangular pad is horizontally adjustable; and wherein the rectangular pad is coupled to an adjustable moving horizontal member; and wherein the adjustable moving member is adjustable to move longitudinally over the second fixed horizontal member, and the second fixed horizontal member is coupled longitudinally within the first fixed horizontal member;

a first pair of substantially cylindrical pads coupled to the first fixed vertical member of the frame;

a second pair of substantially cylindrical pads coupled to the frame;

wherein the second pair of cylindrical pads:

(a) are situated between the rectangular pad and the first pair of cylindrical pads;

(b) are situated on the frame at a higher vertical position that the first pair of cylindrical pads;

(c) are vertically adjustable; and (d) are coupled to opposite sides of the adjustable moving vertical member.

* * * * *